US005643011A

United States Patent [19]

Tsai

[11] Patent Number: 5,643,011

[45] Date of Patent: Jul. 1, 1997

[54] SECURING STRUCTURE OF DECORATIVE LIGHT BULB SOCKET

[76] Inventor: Chin-Sung Tsai, No. 65, Shien-cheng 11 St., Chupei, Hsinchu Shien, Taiwan

[21] Appl. No.: 634,235

[22] Filed: Apr. 18, 1996

[51] Int. Cl.[6] ..... H01K 1/00

[52] U.S. Cl. ..... 439/619; 439/356

[58] Field of Search ..... 439/619, 356, 439/353

[56] References Cited

U.S. PATENT DOCUMENTS

| | | | |
|---|---|---|---|
| 3,876,896 | 4/1975 | Albrecht et al. | 439/619 |
| 4,999,751 | 3/1991 | Chen | 439/356 |
| 5,580,159 | 12/1996 | Liu | 439/356 |
| 5,588,863 | 12/1996 | Wu | 439/356 |

*Primary Examiner*—Khiem Nguyen
*Assistant Examiner*—Yong Ki Kim
*Attorney, Agent, or Firm*—Morton J. Rosenberg; David I. Klein

[57] ABSTRACT

The invention relates to an improved structure of a decorative light bulb socket, mainly comprising a light bulb holder having a slot and a vertical gap on its base and two lips beside the gap and a socket having a projection with an inner channel on its side. When a light bulb is fitted in the holder as well as the holder is put into the socket, the gap will be closed and the lips are inserted into the channel of the projection which will achieve a firm connection among the light bulb, the holder, and the socket.

1 Claim, 6 Drawing Sheets

SECURING STRUCTURE OF DECORATIVE LIGHT BULB SOCKET

SUMMARY OF THE INVENTION

A typical decorative light bulb series is composed of a plurality of small light bulbs connected together. In such an assembly, one of the most frequently seen failure is that the connection between the light bulb and the socket is not firm enough so that it loosens during packing operation or transportation, resulting in a defective product.

In view of the above-mentioned drawbacks, the object of the present invention is to provide an improved securing structure of a decorative light bulb socket that uses an efficient holding means to enable a decorative light bulb to be firmly held by the socket, reducing the possibility of loosening and failure.

The structure, features, and advantages of the present invention will be now described in detail with reference to the accompanying drawings.

DETAILED DESCRIPTION OF PREFERRED EMBODIMENTS

Figure 1:
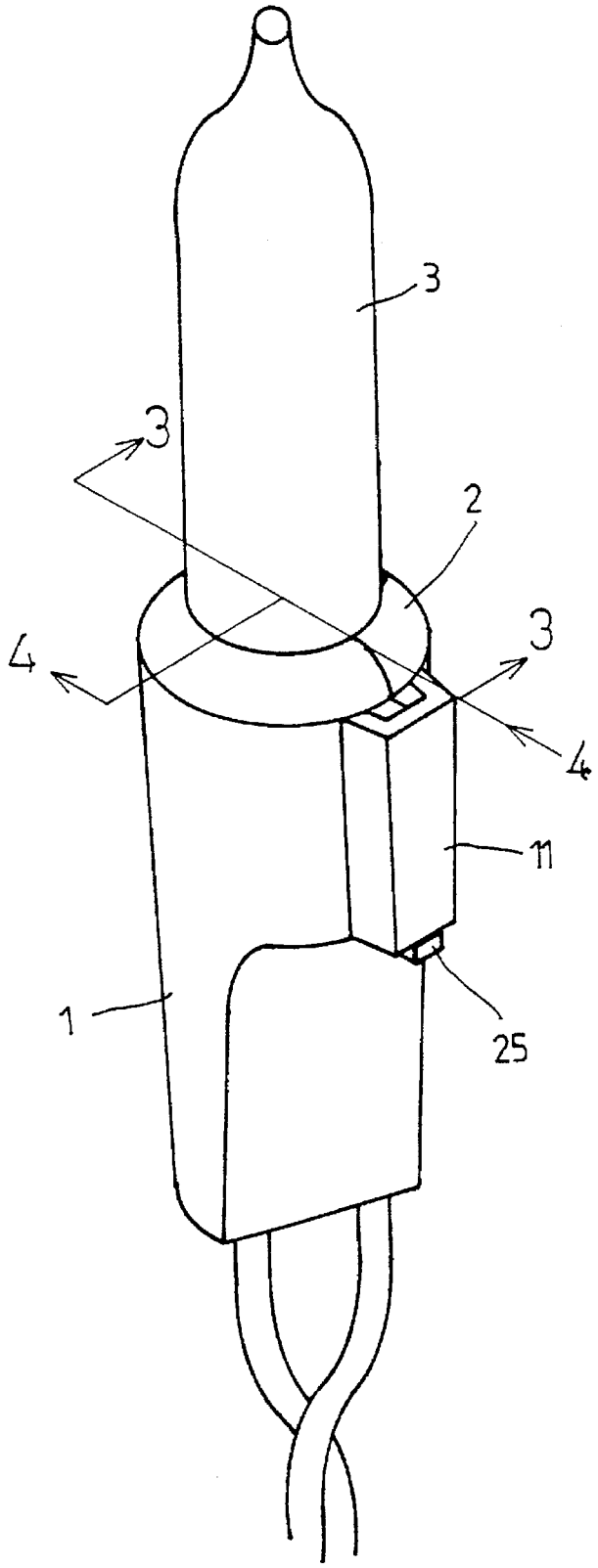
FIG. 1 is a perspective view showing a decorative light bulb socket according to the invention.
Figure 2:
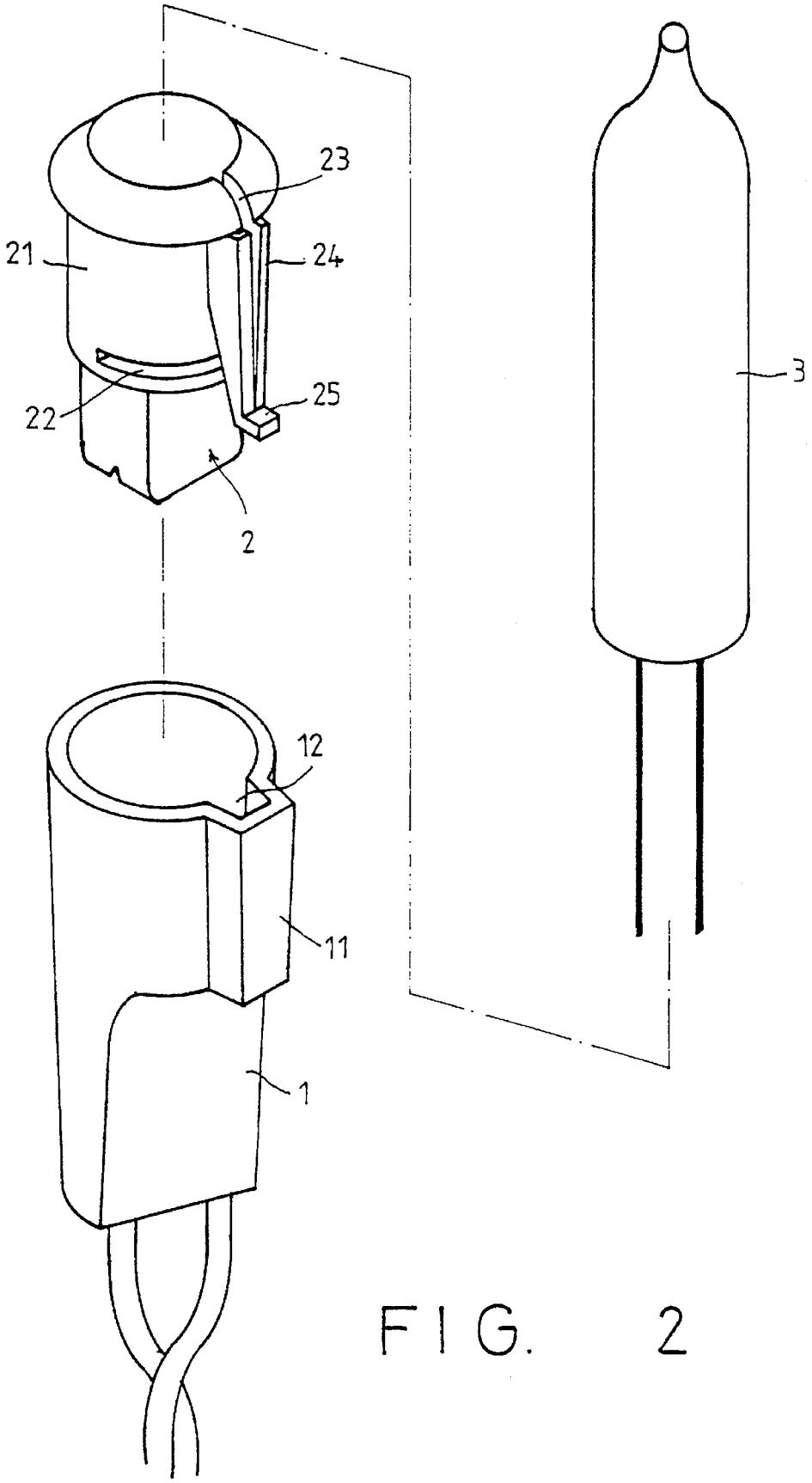
FIG. 2 is an exploded view of the light bulb socket shown in FIG. 1.

Referring to the FIGS. 1 to 4, the light bulb socket assembly according to the present invention includes a socket (1) and a light bulb holder (2) suitable for receiving a light bulb (3). The socket (1) has a projection (11) having an inner channel (12) on its side. The base (21) of the light bulb holder (2) has a slot (22) at bottom side and a vertical gap (23) on its side. A pair of lips (24) are formed beside the gap (23) and the ends of two lips (24) are connected together to form a locking terminal (25).

Figure 3:
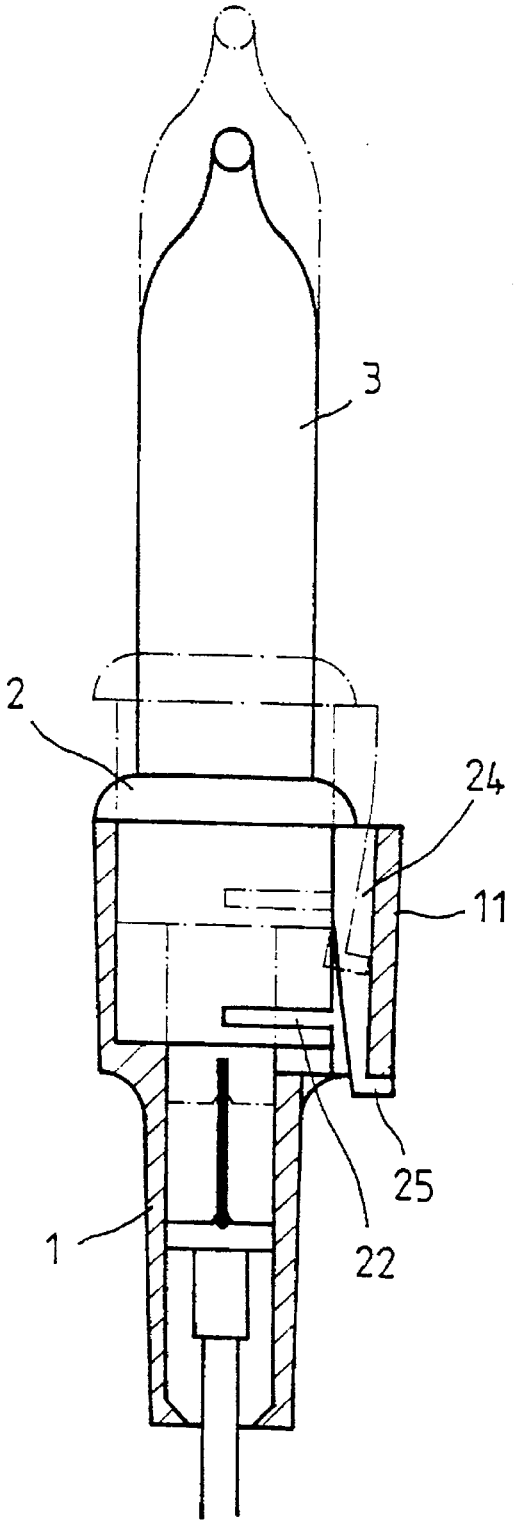
FIG. 3 is a cross sectional view of the light bulb socket along line 3—3 shown in FIG. 1.
Figure 4:
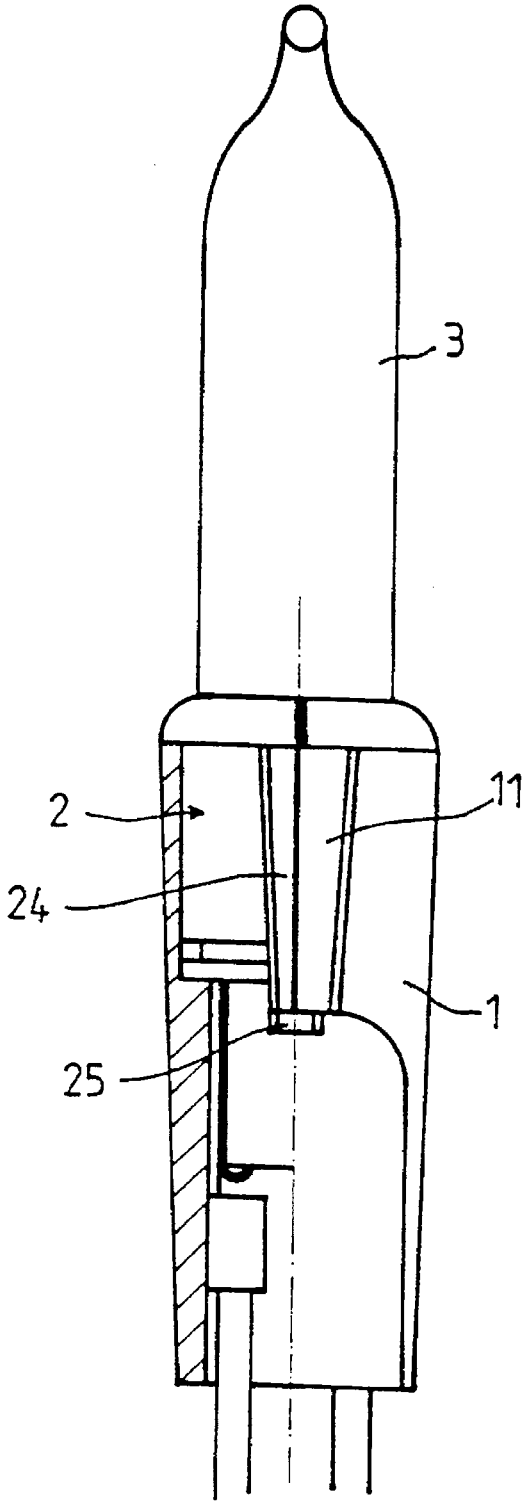
FIG. 4 is a cross sectional view of the light bulb socket along line 4—4 shown in FIG. 1.
Figure 5:
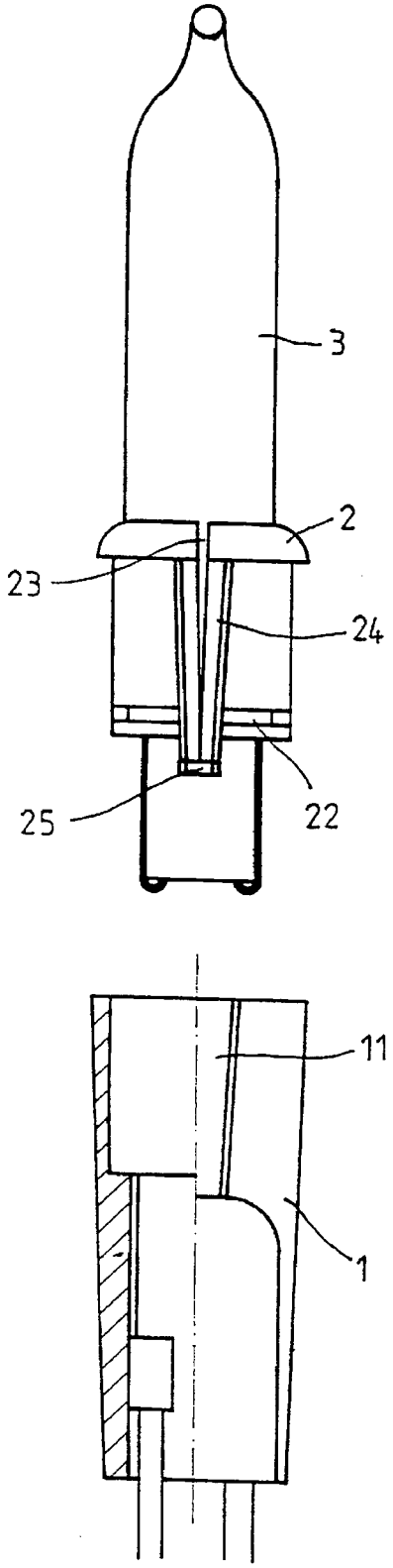
FIG. 5 is an exploded view of the light bulb socket shown in FIG. 4.
Figure 6:
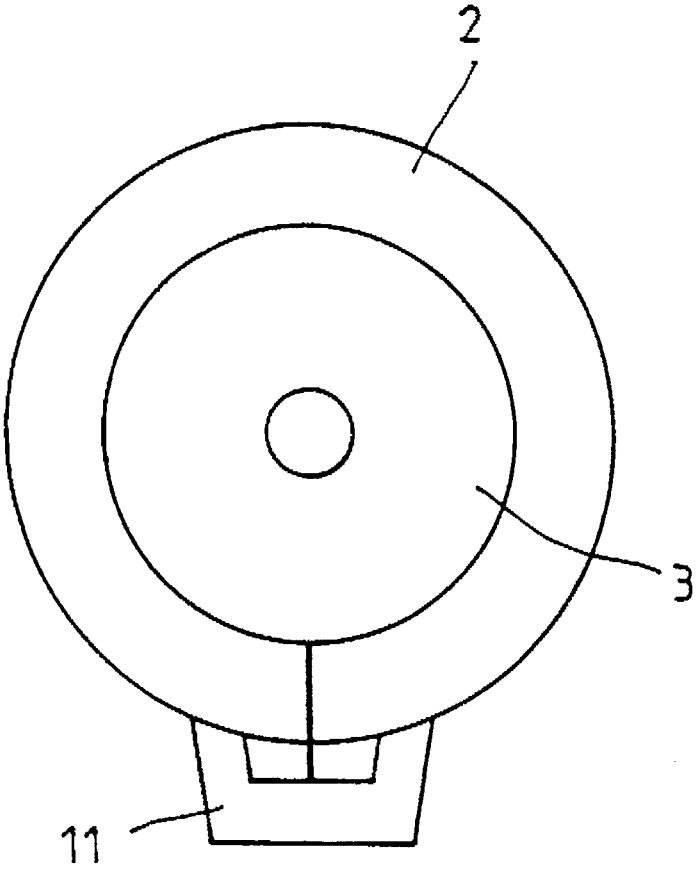
FIG. 6 is a top plan view of the light bulb socket shown in FIG. 1 of the invention.

When assembling, the light bulb (3) is inserted into the light bulb holder (2), and then the light bulb holder (2) is put into the socket (3). At this time, the base (21) of the light bulb holder (2) is press by the socket (3) and the gap (23) will be closed to let the holder (2) becoming smaller and tightly pressing the lower part of the light bulb (3) as shown in FIG. 1 and FIG. 6. Referring to FIGS. 3 to 5, when the assembly is completed, the lips (24) of the holder (2) are inserted into the channel (12) of the projection (11) of the socket (1) whereas the locking terminal (25) of the lips (24) is placed at the bottom of the projection (11). Thus it can obtain a firmly securing effect between the holder (2) and the socket (1).

From the above described, a light bulb socket according to the present invention evidently has an improved holding ability that has not been found in a prior art one. Hence we hereby request a patent grant to us.

What is claimed is:

1. A securing structure for a decorative light bulb socket comprising a socket and a light bulb holder suitable for receiving a light bulb and characterized in that:

the socket having a projection with an inner channel on its side to receive the light bulb holder of which a slot and a vertical gap being formed on its base and two lips disposed beside the gap having their ends connected together forming a locking terminal which is placed at a bottom of the projection of the socket when assembling and the gap is thus closed and thereof obtaining a tightly securement among the light bulb, the holder, and the socket.

* * * * *